US008556103B2

(12) United States Patent
Tiesberger

(10) Patent No.: US 8,556,103 B2
(45) Date of Patent: Oct. 15, 2013

(54) CLOSURE TO BE SCREWED ONTO A CONTAINER

(75) Inventor: Kai Tiesberger, Niedernhausen (DE)

(73) Assignee: Sanner GmbH, Bensheim (DE)

( * ) Notice: Subject to any disclaimer, the term of this patent is extended or adjusted under 35 U.S.C. 154(b) by 101 days.

(21) Appl. No.: 13/122,915

(22) PCT Filed: Oct. 8, 2008

(86) PCT No.: PCT/EP2008/008497
§ 371 (c)(1),
(2), (4) Date: Jun. 3, 2011

(87) PCT Pub. No.: WO2010/040366
PCT Pub. Date: Apr. 15, 2010

(65) Prior Publication Data

US 2011/0226770 A1 Sep. 22, 2011

(51) Int. Cl.

| | |
|---|---|
| ***B65D 51/18*** | (2006.01) |
| ***B65D 41/04*** | (2006.01) |
| ***B65D 85/00*** | (2006.01) |
| ***B65D 39/00*** | (2006.01) |
| ***B65D 41/00*** | (2006.01) |

(52) U.S. Cl.
USPC ..... 220/254.8; 220/254.1; 220/256.1; 220/288; 220/521; 215/227; 206/219; 206/221

(58) Field of Classification Search
USPC ..... 220/254.1, 254.8, 256.1, 259.3, 259.4, 220/288, 293, 296, 521; 215/227, DIG. 8; 206/219, 221
See application file for complete search history.

(56) References Cited

U.S. PATENT DOCUMENTS

| | | | | |
|---|---|---|---|---|
| 6,045,254 | A * | 4/2000 | Inbar et al. | 366/130 |
| 7,942,287 | B2 * | 5/2011 | King | 220/296 |
| 2005/0173435 | A1 * | 8/2005 | Wellman et al. | 220/254.1 |
| 2008/0223740 | A1 * | 9/2008 | Ramsey et al. | 206/222 |
| 2010/0078438 | A1 * | 4/2010 | Lee et al. | 220/521 |

FOREIGN PATENT DOCUMENTS

| | | | |
|---|---|---|---|
| DE | 299 16 436 U1 | 2/2001 | |
| EP | 1 707 495 | 10/2006 | |
| WO | WO 2006/046725 | 5/2006 | |
| WO | WO 2007/073064 A1 * | 6/2007 | B65D 51/28 |

OTHER PUBLICATIONS

International Search Report, mailed Sep. 17, 2009 for PCT International Application No. PCT/EP2008/008497.

* cited by examiner

*Primary Examiner* — Anthony Stashick
*Assistant Examiner* — Madison L Poos
(74) *Attorney, Agent, or Firm* — Greer, Burns & Crain, Ltd.

(57) ABSTRACT

With an eye towards achieving the objective of configuring and refining a closure in such a way that an available space defined by the support element is effectively utilized while the volume of the chamber is maximized, a closure to be screwed onto a container, comprises a closure cap and a screw cap that can be twisted together with each other as well as relative to each other, whereby the closure cap has a support element that can be screwed to the screw cap, whereby the closure cap and the screw cap delimit a chamber that holds a substance and that can be opened by twisting the screw cap relative to the closure cap, thereby opening up at least one passage, and whereby the screw cap has a chamber wall whose free end surrounds a chamber bottom that is formed in the closure cap, wherein the screw cap has a lid section onto which the chamber wall is formed.

13 Claims, 14 Drawing Sheets

CLOSURE TO BE SCREWED ONTO A CONTAINER

CROSS-REFERENCE TO RELATED APPLICATIONS

This application is a National Phase Application of PCT International Application No. PCT/EP2008/008497, International Filing Date Oct. 8, 2008, which is incorporated by reference herein.

FIELD OF INVENTION

The invention relates to a closure to be screwed onto a container, comprising a closure cap and a screw cap that can be twisted together with each other as well as relative to each other, whereby the closure cap has a support element that can be screwed to the screw cap, whereby the closure cap and the screw cap delimit a chamber that holds a substance and that can be opened by twisting the screw cap relative to the closure cap, thereby opening up at least one passage, and whereby the screw cap has a chamber wall whose free end surrounds the chamber bottom that is formed in the closure cap.

BACKGROUND OF INVENTION

Such a closure is already known from German utility model DE 299 16 436 U1. This generic closure serves to be placed onto a container into which the substance held in the container is to be filled. By moving the screw cap, the chamber wall executes an axial movement, so that a passage can be opened up through which the substance can flow into the container.

In this context, it is conceivable for the substance to be liquid, solid or pasty. In particular, with closures of this type, substances can be stored that are only to be brought into contact with these contents shortly before the consumption of the contents.

As soon as the screw cap or its chamber wall has opened up the passage, the substance can reach the inside of the container and can mix with its contents. The container can be shaken for this purpose.

SUMMARY OF THE INVENTION

The generic publication discloses a screw cap with a chamber wall that is positioned in the area of the chamber bottom at a relatively large distance from the support element. In this area, the chamber wall is at a distance from the inner wall of the support element, thereby forming a relatively large annular space. The free end of the chamber wall surrounds the chamber bottom, and likewise forms a relatively large annular space between the passage and the chamber bottom. Moreover, the screw cap has an intermediate space that is open and that is configured at the end of the screw cap facing away from the chamber bottom. This intermediate space is delimited by a partition-like, slanted crown. The partition-like crown allows the chamber wall to be hinged and carried along when the screw cap is twisted. In the prior-art closure, it is a drawback that the available space defined by the support element is not effectively utilized. Therefore, the volume of the chamber that holds the substance ends up being relatively small.

Before this backdrop, the invention is based on the objective of configuring and refining a closure of the above-mentioned type in such a way that the available space defined by the support element is effectively utilized while the volume of the chamber is increased.

Accordingly, a closure to be screwed onto a container of the above-mentioned type is characterized in that the screw cap has a lid section onto which the chamber wall is formed.

In the manner according to the invention, it was first realized that the available space defined by the support element can be effectively utilized in that the chamber wall delimits the smallest possible annular space with the support element. An especially small annular space can be achieved here in that the screw cap and the chamber wall have a shared lid section. In particular, it was realized that it is possible to dispense with carrier means such as a partition-like crown in order to axially move the chamber wall by means of the screw cap. In this manner, the chamber bottom can be configured with such a diameter that its edge area that is surrounded by the chamber wall extends as closely as possible to the passage. In this manner, if the chamber wall is configured to be appropriately thin, almost the entire clearance of the support element can be used to form, for example, a cylindrical volume for the chamber. Hence, the volume of the chamber is maximized by utilizing the available space defined by the support element.

The screw cap could be twisted relative to the closure cap with a certain amount of play without the closure cap being twisted along, and then, after the section with the play has been passed, the screw cap could carry along the closure cap. Through this concrete configuration, first of all, the screw cap can be moved together with the chamber wall in order to open up the passage or passages by means of the relative axial movement that results from the twisting motion along the thread. After the section with the play has been passed, the closure cap can be unscrewed from the container by means of the screw cap.

In this context, it is also conceivable that, after the section with the play has been passed, the screw cap cannot carry along the closure cap since the closure cap has to be unscrewed from the container by turning it in the opposite direction. In this manner, it can be ensured that the closure cap is not inadvertently removed from the container when the screw cap is twisted.

The screw cap and the support element of the closure cap could be locked by at least one thread locking mechanism in such a way that, after the screw cap has traversed a twisting segment relative to the closure cap, further relative twisting of the screw cap in the same direction of rotation is blocked. By configuring one or more thread locking mechanisms, it is ensured that the screw cap is connected to the closure cap so that it cannot come off Moreover, the thread locking mechanism makes it possible for the screw cap to first be rotatable relative to the closure cap with a certain amount of play without the closure cap being twisted along. After the section with the play has been passed, the thread locking mechanisms create a block that prevents any further twisting of the screw cap relative to the closure cap in the current direction of rotation. Moreover, in this manner, the closure cap can be prevented from being removed from the screw cap.

A thread locking mechanism could be configured as a spring-loaded finger that is located in the outer thread of the support element and that, under elastic pre-tensioning, can be laid with its blocking surface against the inner thread of the screw cap. Here, it is also conceivable to provide two or more spring-loaded fingers in order to distribute the forces that occur. The spring-loaded fingers could be configured on the upper edge of the outer thread of the support element so that the threads of the screw cap can remain intermeshed with the threads of the closure cap, while the screw cap and the closure cap are twisted together. Spring-loaded fingers that can be laid against the inner thread of the screw cap under elastic pre-tensioning can be pressed radially inwards by the threads of the screw cap against the elastic pre-tensioning. In the state in which the spring-loaded fingers are pressed radially inwards, namely, when they have been put into place, the spring-loaded fingers exert no resistance or at least no resistance that would be detrimental for the inner thread of the screw cap, and they cannot have a blocking effect. As a result, the closure cap and the screw cap can be screwed together without any problem in order to be assembled after the chamber has been filled with the substance, without the spring-loaded fingers hindering this.

In this context, the individual threads of the inner thread of the screw cap can be configured with interruptions into which the spring-loaded fingers could click. Due to the elastic pre-tensioning of the spring-loaded fingers, which forces them radially outwards, the spring-loaded fingers can then engage into the interruptions when they are released by the continuous threads.

The interruptions could have steep flanks against which the blocking surfaces of the spring-loaded fingers can be laid. Due to this concrete configuration, the spring-loaded fingers can click into the interruptions and can be placed so that their blocking surfaces lie against the steep flanks of the interruptions so as to lock. In this manner, the spring-loaded fingers bring about a blocking effect that prevents twisting of the screw cap relative to the closure cap in the current direction of rotation. At the same time, the screw cap can be twisted opposite to the current direction of rotation and the spring-loaded fingers can be once again pushed radially inwards by the continuous threads.

A spring-loaded finger could click into the outer thread of the closure cap in an undercut formed there. The undercut can easily be formed during production by means of injection molding. Here, the spring-loaded finger can be configured in such a way that, in the undeformed state, it protrudes outwards from the thread. As a result, the spring-loaded fingers acquire elastic pre-tensioning facing radially outwards.

A slanted or beveled surface of the chamber bottom could be facing the chamber. Due to this concrete configuration, the substance, especially a free-flowing substance, can particularly easily reach the container through one or more passages. The substance can then slide into the container along the slanted or beveled surface.

Before this backdrop, the surface could be configured as a conical surface. A conical surface forms an optionally rounded tip that advantageously distributes the substance symmetrically onto the conical surface, thereby allowing the substance to slide on the conical surface down into the container through the passage or passages.

The passage that connects the chamber to the container could be configured as a recess in a connection wall that has a U-shaped cross section so that the chamber bottom is shaped onto the closure cap. Several recesses could be made in the U-shaped connection wall without forming shoulders in order to create the passage or passages as well as partitions. By dispensing with shoulders of the type put forward in the generic publication, the formation of clumps and incrustations of the substance on any such shoulders can be avoided. The substance can slide off the slanted or beveled surface through the passage or passages, and down into the container especially quickly and completely, without having to overcome obstacles.

In this context, examples of substances that can be filled into the chamber include vitamin powder, flavoring agents or liquids such as syrup or concentrates. The container could hold, for example, mineral water. It goes without saying, however, that the closure is also suitable for other substances.

The free end of the chamber wall of the screw cap could have a first encircling sealing bead that can be laid against the chamber bottom so as to create a seal. The sealing bead ensures that the substance inside the chamber is separated from the contents of the container. In this manner, the substance is preserved and can be stored indefinitely. In this context, it is likewise conceivable that a first sealing bead is arranged on the chamber bottom and it can be laid against the chamber wall so as to create a seal.

The chamber wall of the screw cap could have a second encircling sealing bead that faces away from the free end of said chamber wall and that lies against the inner wall of the support element of the closure cap so as to create a seal. This reliably ensures that the atmosphere is separated from interior of the chamber so as to be sealed, especially sealed air-tight. The first sealing bead serves especially to seal the chamber liquid-tight vis-à-vis the contents of the container. The second sealing bead serves to seal the chamber vis-à-vis the atmosphere. In this context, it is also conceivable for the second sealing bead to be installed on the inner wall of the support element and to lie against the chamber wall so as to create a seal.

The chamber wall of the screw cap could be surrounded by a first threaded crown on which a first safety ring having predetermined breaking points is arranged. The first safety ring indicates to the consumer that the screw cap has not been moved yet and that the substance contained in the chamber is still intact.

In this context, the first safety ring could grasp behind a first edge that is formed around the support element of the closure cap. Through this concrete configuration, the first safety ring can remain on the closure once the screw cap has been detached from the first safety ring by being twisted.

The support element of the closure cap could be surrounded by a second threaded crown on which a second safety ring having predetermined breaking points is arranged, whereby the second safety ring is provided in order to grasp behind a second edge that encircles a container. The second safety ring indicates to the consumer that the container is still sealed, namely, that the closure cap has not been moved yet. A guarantee is given to the consumer that the contents of the container are still intact and have not yet come into contact with the atmosphere. When the closure is removed from the container, the second safety ring remains on the container since it grasps behind a second edge that encircles the container.

On the support element of the closure cap, a third encircling sealing bead protruding outwards could be provided that is laid against the interior of a container. The third sealing bead ensures that the interior of the container is separated airtight and/or liquid-tight from the atmosphere. Here, it is also conceivable for a third encircling sealing bead to be provided on the interior of the container and to be laid against the support element so as to create a seal.

Additional objectives, features, advantages and application possibilities of the present invention ensue from the description below of embodiments making reference to the drawing. In this context, all of the described and/or depicted features on their own or in any desired combination are the subject matter of the invention, irrespective of their compilation in the individual claims and in the claims to which they refer back.

DETAILED DESCRIPTION OF THE INVENTION

Figure 1:
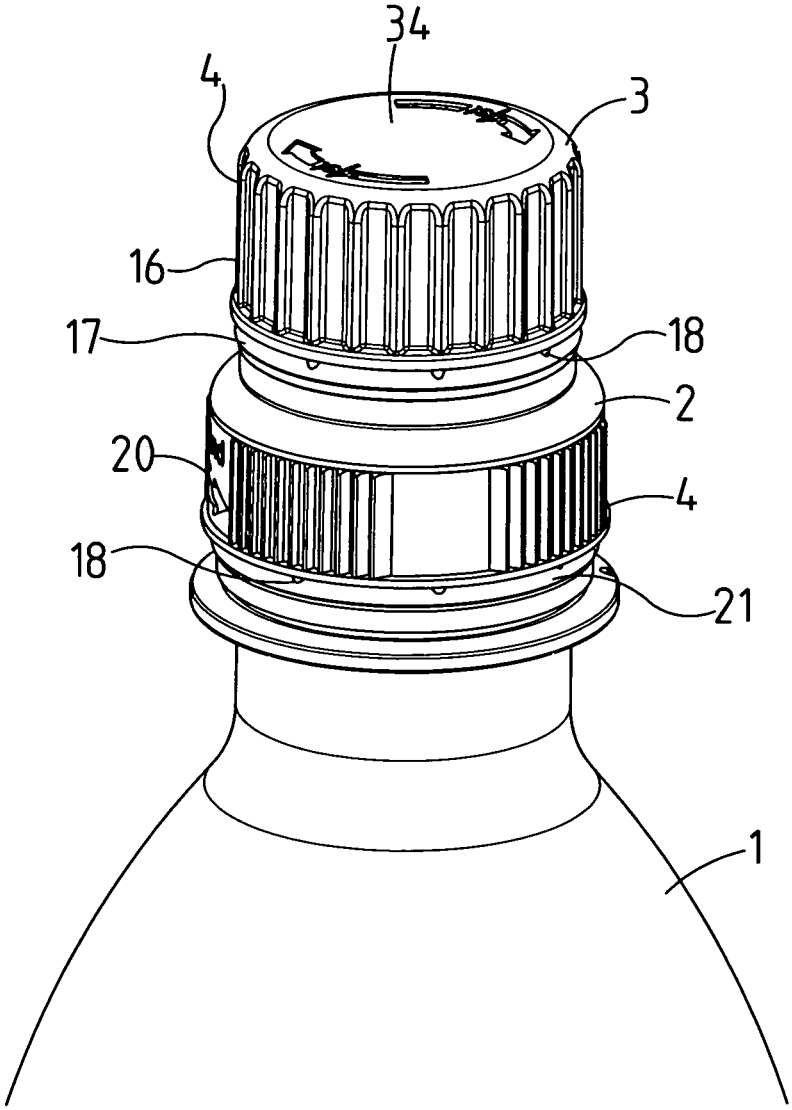
FIG. 1 a container with a closure in the closed state.

FIG. 1 shows a closure to be screwed onto a container 1 (only shown partially here) that is bottle-shaped in the embodiment depicted. On the side of the closure facing the container 1, said closure comprises a closure cap 2 and, on it side facing away from the container 1, said closure comprises a screw cap 3, whereby these two caps can be twisted together relative to the container 1 and also relative to each other. The outside of the closure cap 2 and the outside of the screw cap 3 have a plurality of ridges 4 that make it easier for the user to twist the closure cap 2 and the screw cap 3. In FIG. 1, the screw cap 3 is tightly screwed onto the closure cap 2, so that they are in a closed position in which they are close to each other. The closure cap 2, in turn, is tightly screwed onto the container 1. The container 1 can be delivered from the factory in this state. The screw cap 3 and the closure cap 2 are movably joined to each other with a left-handed thread. A chamber 6, described in greater detail below, is delimited by a chamber wall 8 and is incorporated into the closure.

Figure 2:
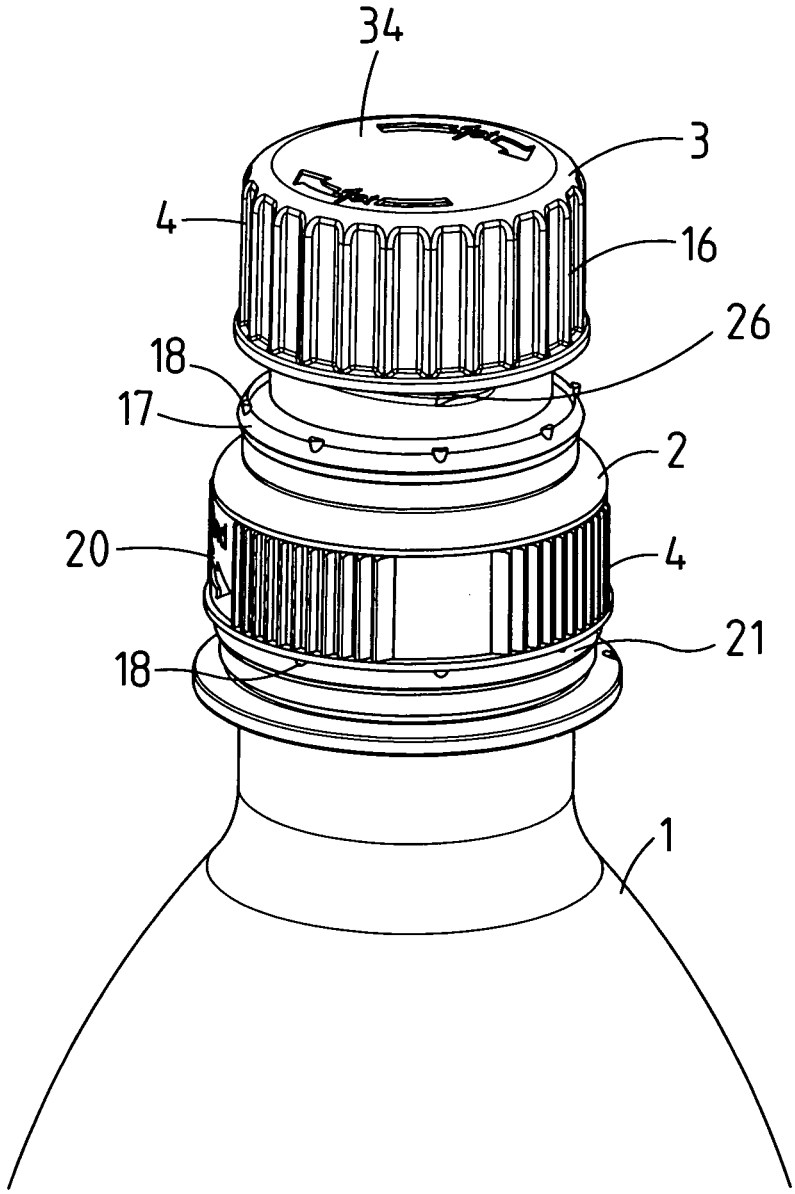
FIG. 2 a container according to FIG. 1 in which the screw cap is partially screwed on, FIG. 3 a container according to FIG. 1 and FIG. 2 in which the closure, along with a partially screwed-on screw cap, has been taken off the container, FIG. 4 a sectional view of the closure and of the container according to FIG. 1, FIG. 5 a sectional view of the container and of the closure according to FIG. 2, in which the screw cap is partially unscrewed, FIG. 6 a sectional view of the container and of the closure according to FIG. 3, whereby the closure has been taken off the container, FIG. 7 a sectional view of the closure cap and of the screw cap in the state where they have been separated from each other, FIG. 8 a side view and a top view of the screw cap as well as a detailed view of the screw cap, FIG. 9 a side view and a sectional view of the closure cap as well as a detailed view of a spring-loaded finger, FIG. 10 a side view of the closure, a sectional view along the horizontal broken sectional line as well as a perspective detailed view of the spring-loaded finger that is engaged in an interruption, FIG. 11 a perspective view of the screw cap as well as a detailed view of an interruption in the threads of the inner thread of the screw cap, FIG. 12 another sectional view of the screw cap and of the closure cap as well as a detailed view of the spring-loaded finger according to FIG. 11, FIG. 13 a side view of the screw cap and a perspective view of an oblique view through the screw cap along the slanted broken sectional line, and FIG. 14 a cross sectional view and a top view of the screw cap.

FIG. 2 shows the closure according to FIG. 1, whereby the screw cap 3 is partially unscrewed from the closure cap 2 and is in a mixing position in which a passage has been opened between the chamber 6 and the container 1. In order to axially move the chamber wall 8 and thus in order to open up at least one passage 7, the screw cap 3 is twisted relative to the closure cap 2 along the thread. As compared to the position shown in FIG. 1, this results in a position that is axially offset in which the screw cap 3 is at a greater distance from the container 1. In the embodiment shown, the screw cap 3 is twisted opposite to the direction of rotation in which the closure cap 2 can be unscrewed from the container 1. When the screw cap 3 is twisted, a first safety ring 17 is detached from the screw cap 3 at the predetermined breaking points 18, but remains on the closure cap 2. A substance (not shown) that is held in the chamber 6 now reaches the container 1. If applicable, the contents of the container 1 can be mixed with the substance by shaking the container 1. In this process, the contents of the container 1 can pass through the chamber 6 while the closure provides a liquid-tight seal vis-à-vis the atmosphere.

Figure 3:
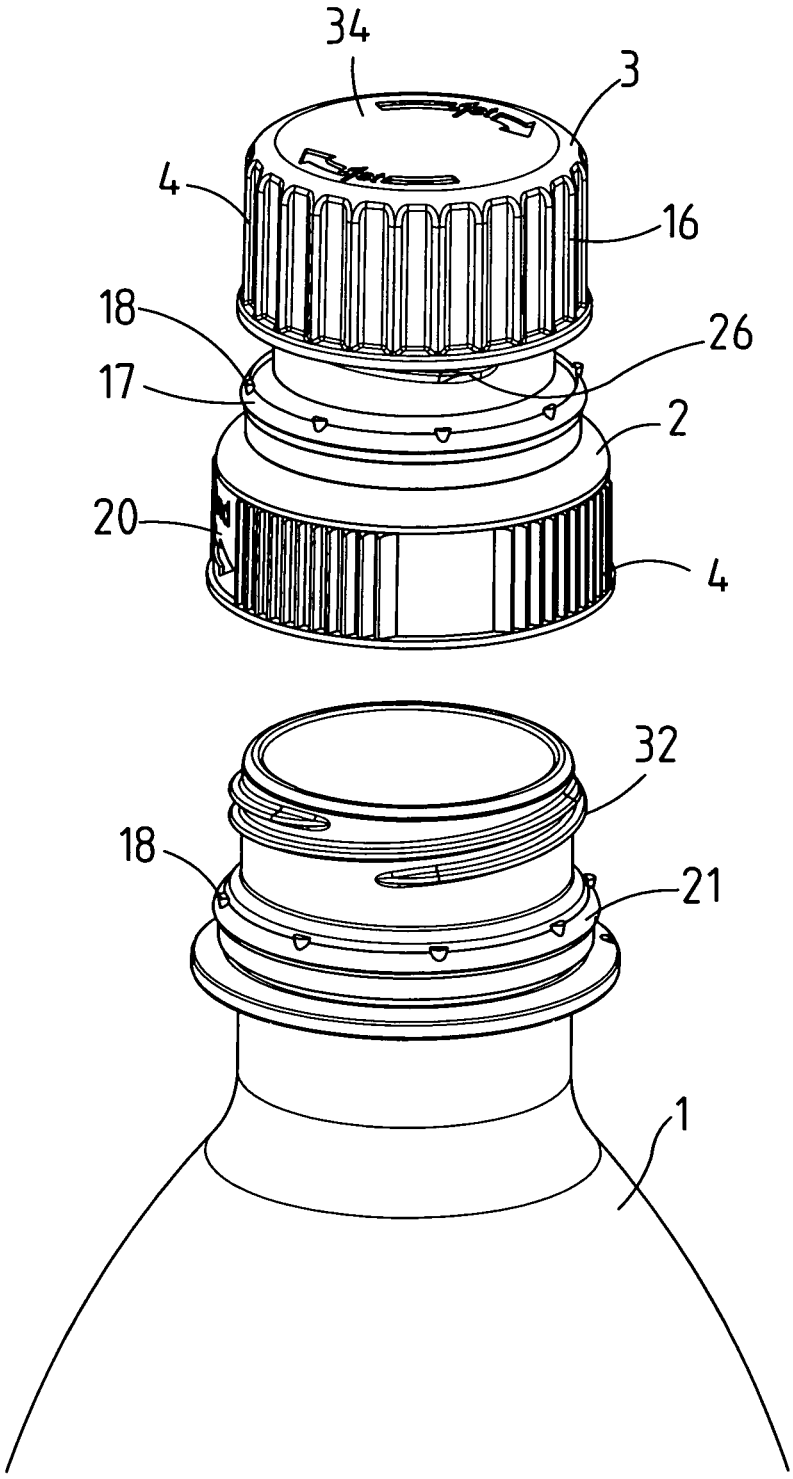

FIG. 3 shows the closure according to FIG. 1 and FIG. 2, whereby the closure is unscrewed from the container 1. To put it in very concrete terms, the closure cap 2 is unscrewed from the container 1, and the screw cap 3 is at least partially unscrewed from the closure cap 2. The closure cap 2 is detached from a second safety ring 21, which remains on the container 1.

The first safety ring 17 and the second safety ring 21 could also be configured as tear-off strips. They would have to be torn off before the closure cap 2 and the screw cap 3 are twisted.

Figure 4:
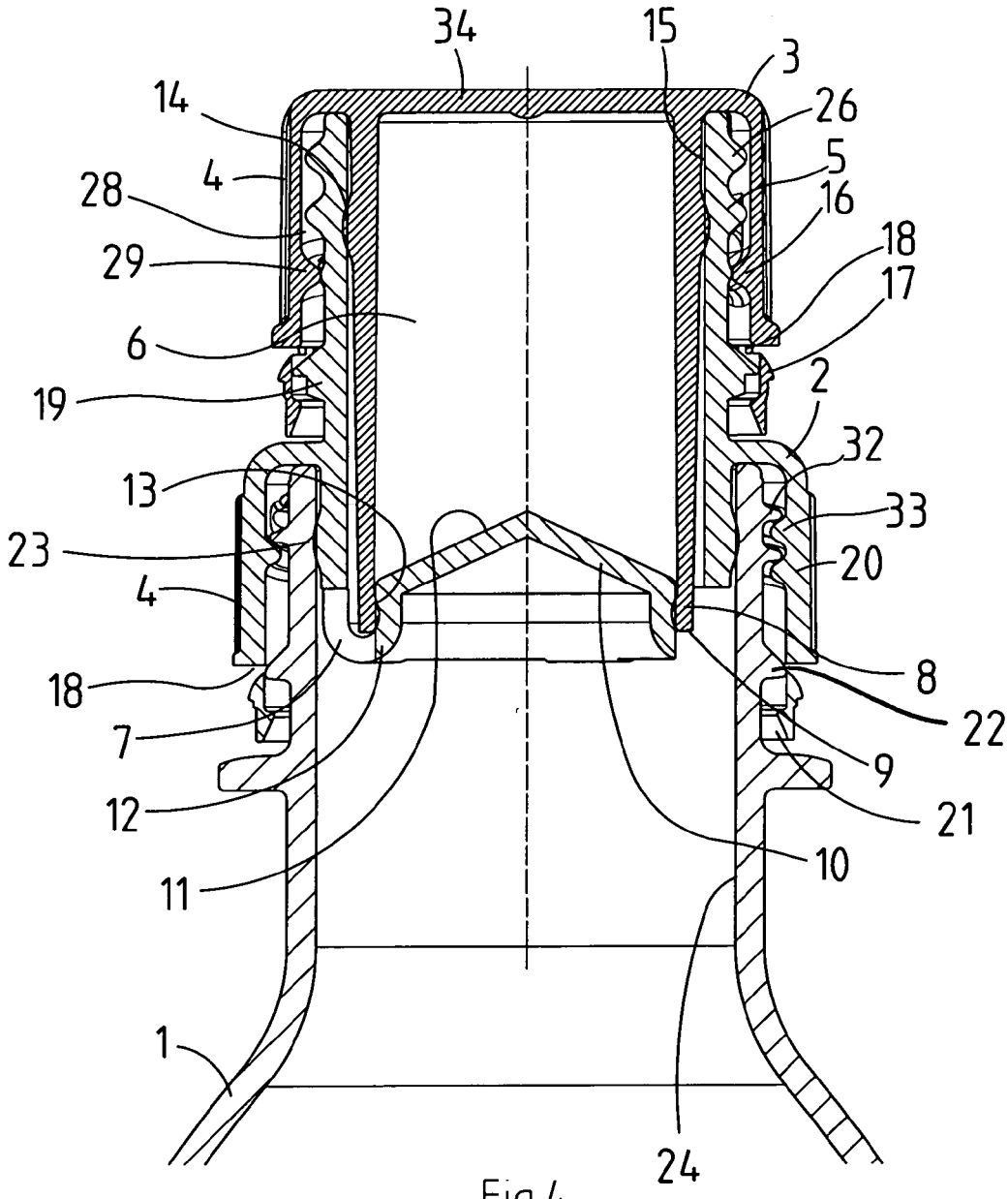

FIG. 4 shows a sectional view of the container 1 and of the closure according to FIG. 1, in the closed state. The closure comprises the closure cap 2 and the screw cap 3, which can be twisted together with each other as well as relative to each other, whereby the closure cap 2 has a support element 5. This support element 5 can be screwed to the screw cap 3 by means of the thread. The closure cap 2 and the screw cap 3 form a chamber 6 that is closed on all sides in order to hold a substance, and the chamber 6 can be opened by twisting the screw cap 3 relative to the closure cap 2, a procedure that opens up at least one passage 7.

The figure also shows the chamber wall 8 that is formed on the screw cap 3 and that has a free end 9 surrounding a chamber bottom 10 formed in the closure cap 2. In this manner, a space is formed that holds a substance and that is closed in the position shown in FIG. 4. The side of the screw cap 3 facing away from the container has a lid section 34 onto which the chamber wall 8 is formed.

The lid section 34 is configured integrally with the chamber wall 8 that is configured cylindrically in the example shown. The chamber wall 8 protrudes from the lid section 34 into the support element 5, whereby the lid section 34 covers the support element 5 as a flat, smooth element. The lid section 34 is configured as a flat, smooth element from which the chamber wall 8 and a first threaded crown 16 project coaxially in the same direction.

A slanted or beveled surface 11 of the chamber bottom 10 faces the chamber 6, said surface being configured as a conical surface.

The passage 7 is configured as a recess in a connection wall that has a U-shaped cross section so that the chamber bottom 10 is shaped onto the closure cap 2. In the position shown in FIG. 4, the passage 7 is still closed. The free end 9 of the chamber wall 8 of the screw cap 3 facing the container 1 has a first encircling sealing bead 13 that is laid against the chamber bottom so as to create a seal as long as the closure is in the closed position.

The chamber wall 8 of the screw cap 3 also has a second encircling sealing bead 14 whose free end 9 faces away from the free end of said chamber wall and that lies against the inner wall 15 of the support element 5 of the closure cap 2 so as to create a seal.

The chamber wall 8 of the screw cap 3 is surrounded by the first threaded crown 16, which has an inner thread and on which the first safety ring 17 that has predetermined breaking points 18 is arranged. The first safety ring 17 surrounds a first edge 19 that encircles the support element 5 of the closure cap 2.

The support element 5 of the closure cap 2 has a second threaded crown 20 on the outside on which the second safety ring 21 is provided that grasps behind a second edge 22 that encircles the container 1. The second safety ring 21, likewise with predetermined breaking points 18, is arranged on the second threaded crown 20.

On the support element 5 of the closure cap 2, a third encircling sealing bead 23 that protrudes outwards is configured so as to be laid against the interior 24 of the container 1. This sealing bead seals the interior of the container 1 airtight and/or liquid-tight vis-à-vis the atmosphere. The third sealing bead 23 is configured to encircle the container.

The screw cap 3 has the chamber wall 8, which is configured essentially as the circumferential surface of a cylinder. The chamber wall 8 is concentrically surrounded over part of its height by the first threaded crown 16, which is provided with ridges 4.

The closure cap 2 has an essentially cylindrically configured support element 5 that is provided with an outer thread 26 on its side facing away from the container 1. The second threaded crown 20 is arranged concentrically on the support element 5.

An annular gap is formed between the chamber wall 8 of the screw cap 3 and the inner wall 15 of the support element 5 of the closure cap 2. This annular gap is tapered from the chamber bottom 10 in the direction of the lid 34. The cross section of the chamber bottom 10 comprises two legs 12 slanted towards each other, which, as a body of rotation, form a conical surface.

The container 1 has a container thread 32 onto which the closure cap 2 can be screwed. For this purpose, the closure cap 2 is provided with a closure cap inner thread 33.

Figure 5:
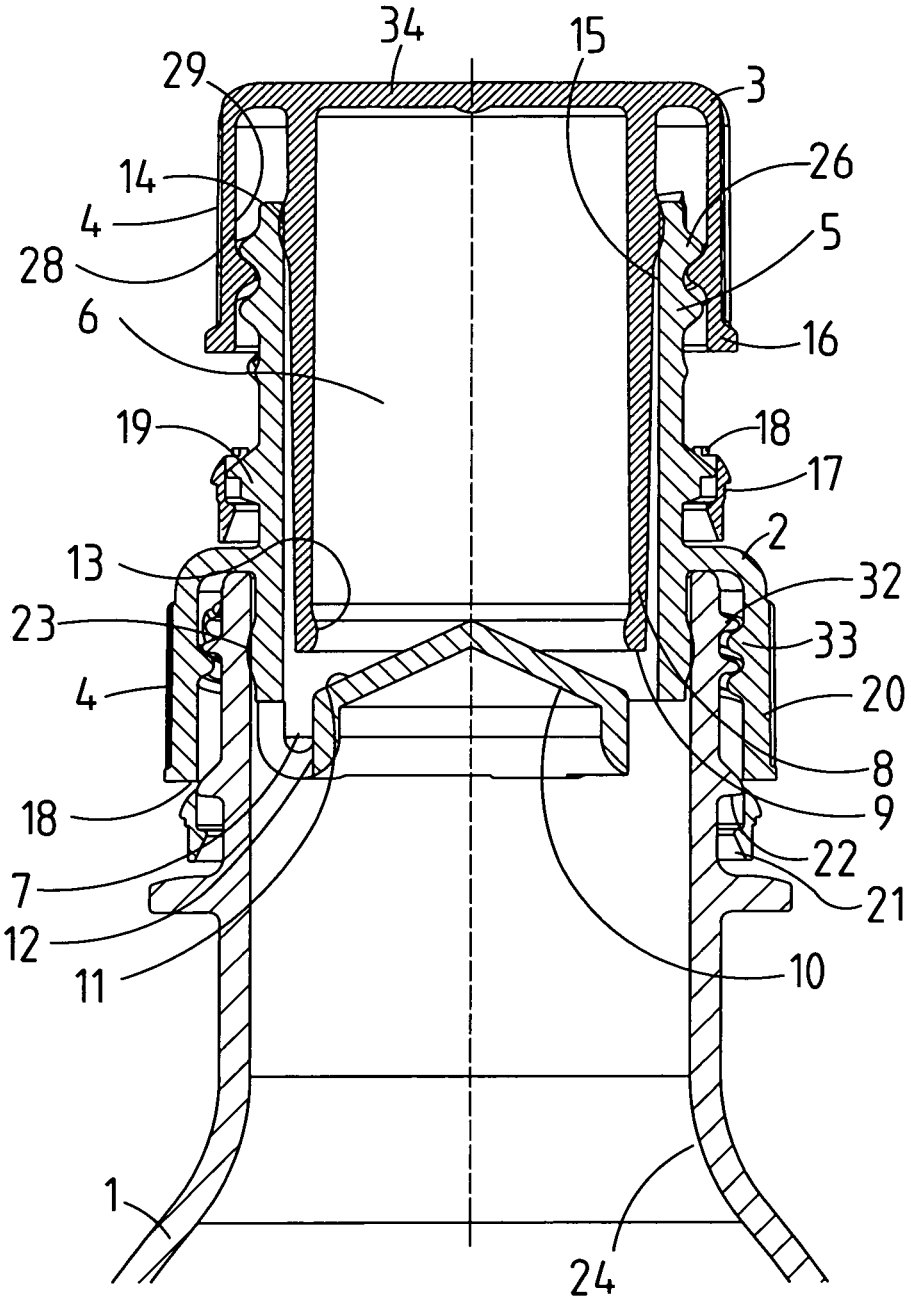

FIG. 5 shows the closure according to FIG. 4 in the mixing position in which the screw cap 3 is partially unscrewed from the closure cap 2. Here, it can be clearly seen that, as a result, the screw cap 3 is offset in the axial direction relative to the closure cap 2 in a direction away from the container 1, so that the lower edge of the chamber wall 8 is lifted up from the chamber bottom 10 and opens up the passage 7. In this position, a substance contained in the chamber 6 can reach the interior of the container 1 through the passage 7.

Figure 6:
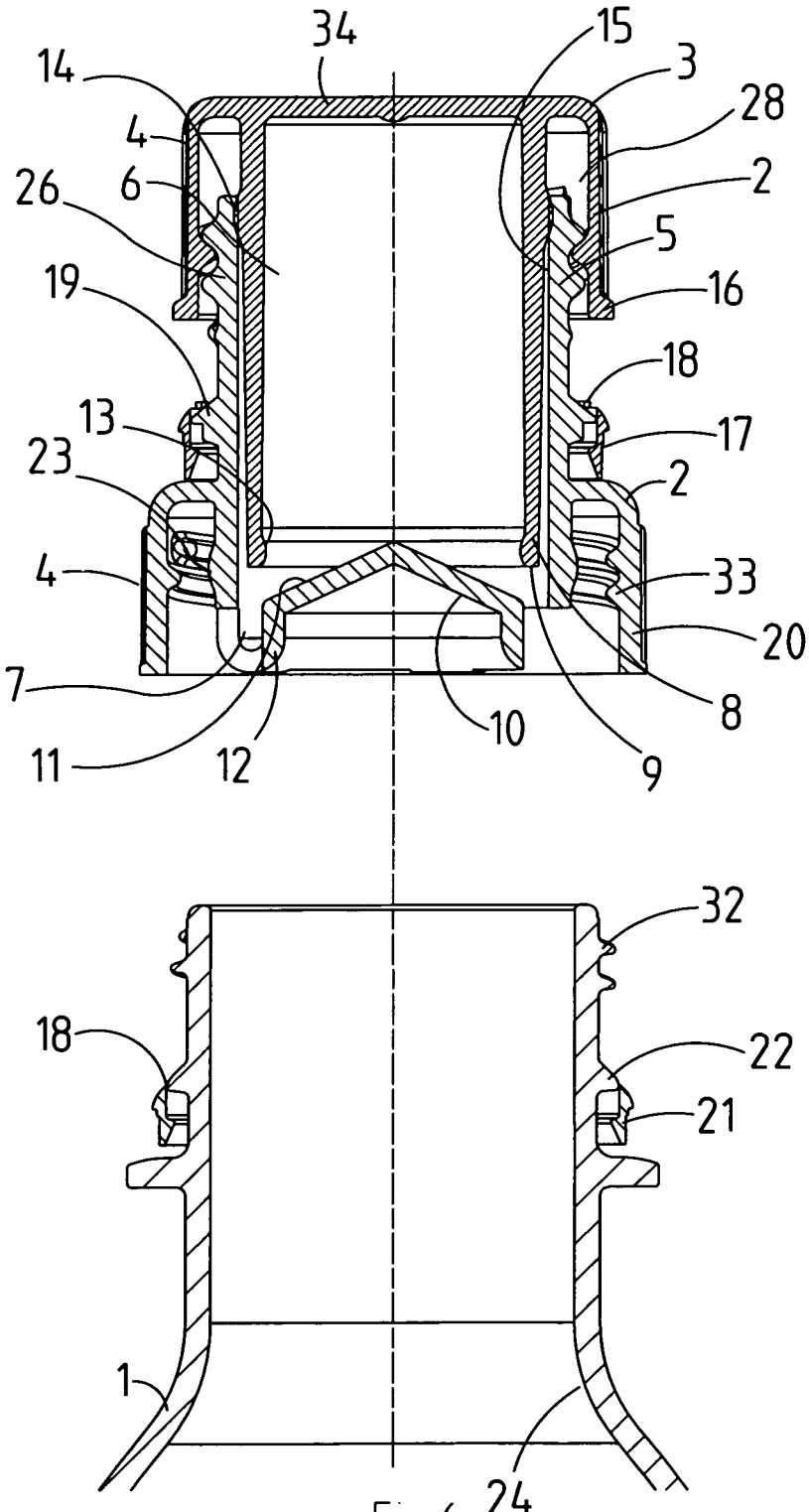

FIG. 6 shows the closure from FIG. 5, whereby the closure cap 2 has been taken off the container 1. In this position, the contents of the container 1, together with the contents of the chamber 6 that had been previously added in the mixing position, can be removed, for example, by pouring the contents through the container opening. The second safety ring 21 remains on the container 1 and grasps behind the second edge 22 that encircles the container 1. The second safety ring 21 was separated from the second threaded crown 20 at the predetermined breaking points 18 by twisting the closure cap 2. The screw cap 3 has been partially unscrewed from the closure cap 2. The first threaded crown 16, which concentrically surrounds the chamber wall 8, is separated from the first safety ring 17 at the predetermined breaking points 18 by twisting the screw cap 3.

Figure 7:
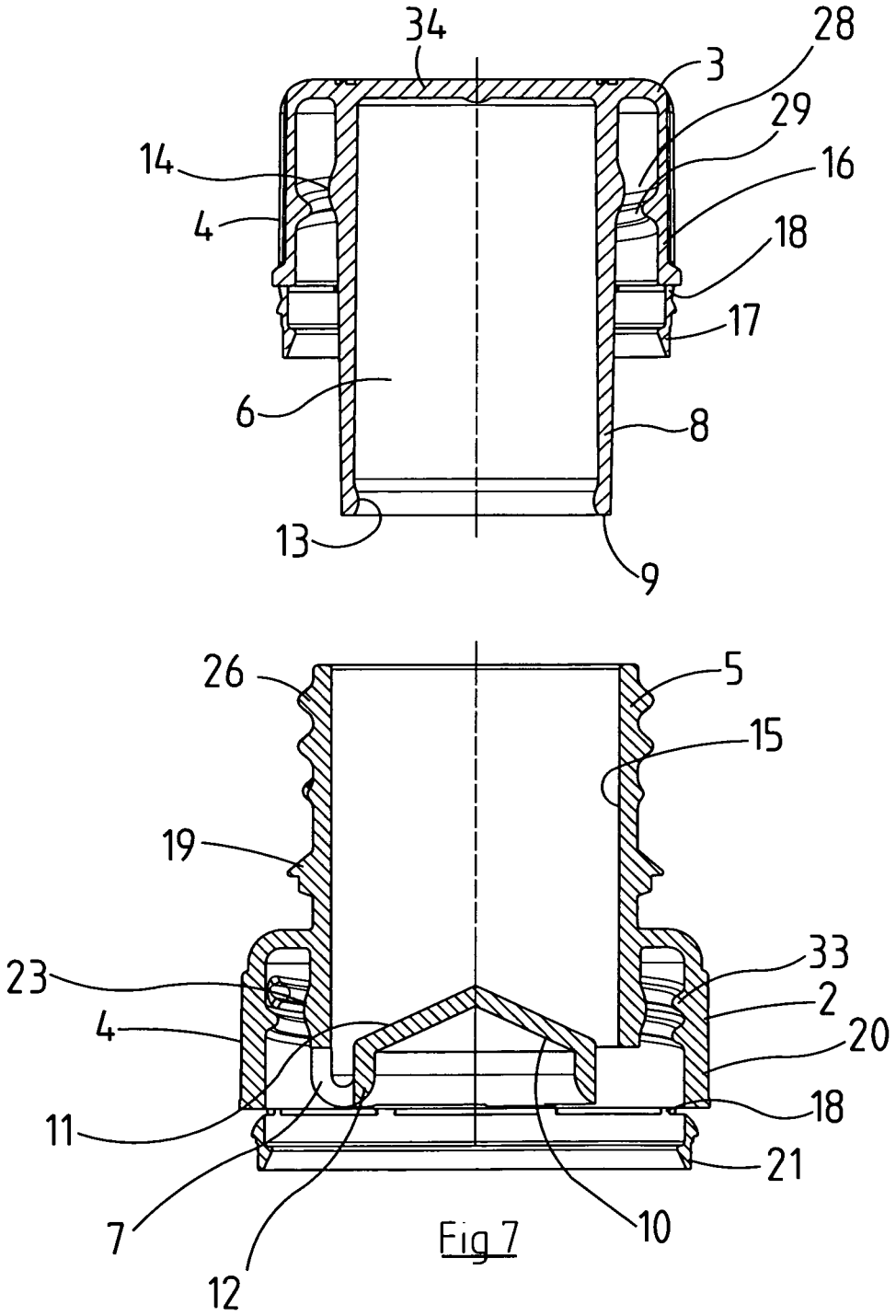

FIG. 7 shows the screw cap 3 and the closure cap 2 in the state where they have been separated from each other. Here, it can be clearly seen that the closure can make do with very few parts which, in addition, are easy to make out of plastic by means of injection molding. This keeps the assembly and production costs down.

Figure 8:
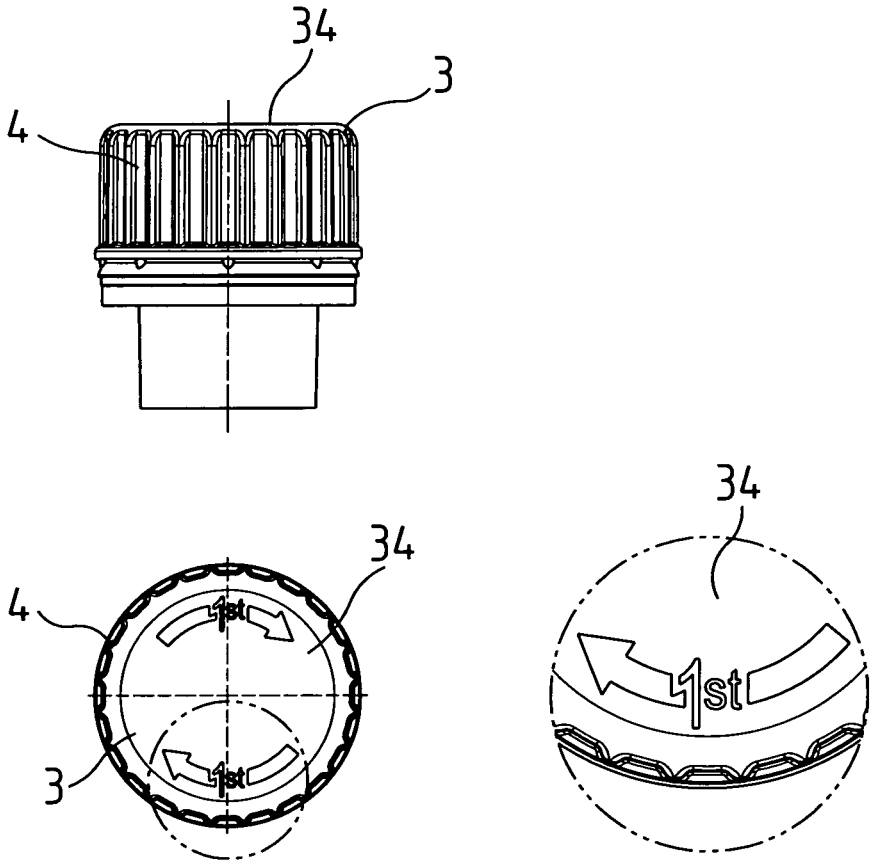

FIG. 8 shows a side view and a top view of the screw cap 3 in a detailed view. The lid section 34 of the screw cap 3 has two arrows indicating the direction of rotation for opening the screw cap 3. The arrow direction indicates to the consumer the direction of rotation in which the screw cap 3 has to be twisted in order to open up the passage 7 of the chamber 6. The marking "1st" on the lid section shown in the detailed view provides consumers with the information that they first have to twist the screw cap 3 and only then the closure cap 2.

Figure 9:
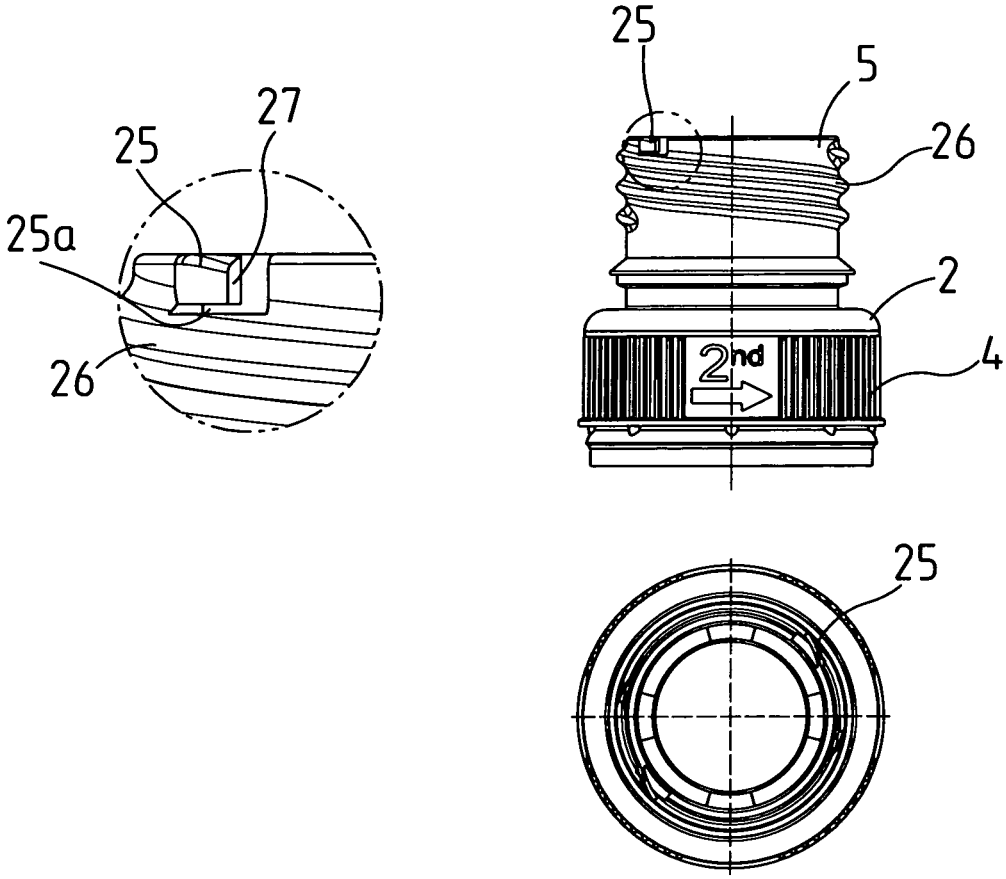

FIG. 9 shows a side view (top right), a sectional view (bottom) and a detailed view of the closure cap 2 (top left). In the side view of the closure cap 2, it can be seen that an arrow indicates to consumers in which direction of rotation they have to twist the closure cap 2. In FIG. 8, the screw cap 3 gives consumers the information that they first ("1st") have to twist the screw cap 3 relative to the closure cap 2, before they secondly ("2nd") detach the closure cap 2 from the container 1. For this purpose, an arrow and the marking "2nd" are indicated on the closure cap 2 in an area that does not have any ridges 4. The arrow shows consumers the direction of rotation in which the closure cap 2 has to be twisted.

In FIG. 9, the detailed view of the side view shows that the closure cap 2 has a thread locking mechanism 25. The thread locking mechanism 25 is configured as a spring-loaded finger that is arranged at the upper edge of the outer thread 26 of the support element 5. The spring-loaded finger faces outwards approximately tangentially from the cylindrical section having the thread and, under elastic pre-tensioning, can be laid with its blocking surface 27 against the inner thread 28 of the screw cap 3. The spring-loaded finger has an undercut **25*a* that is configured on the upper edge of the outer thread 26**. In this manner, the spring-loaded finger can easily be produced by means of injection molding. Moreover, it has an elastic pre-tensioning that exerts a radial pressure towards the outside.

Figure 10:
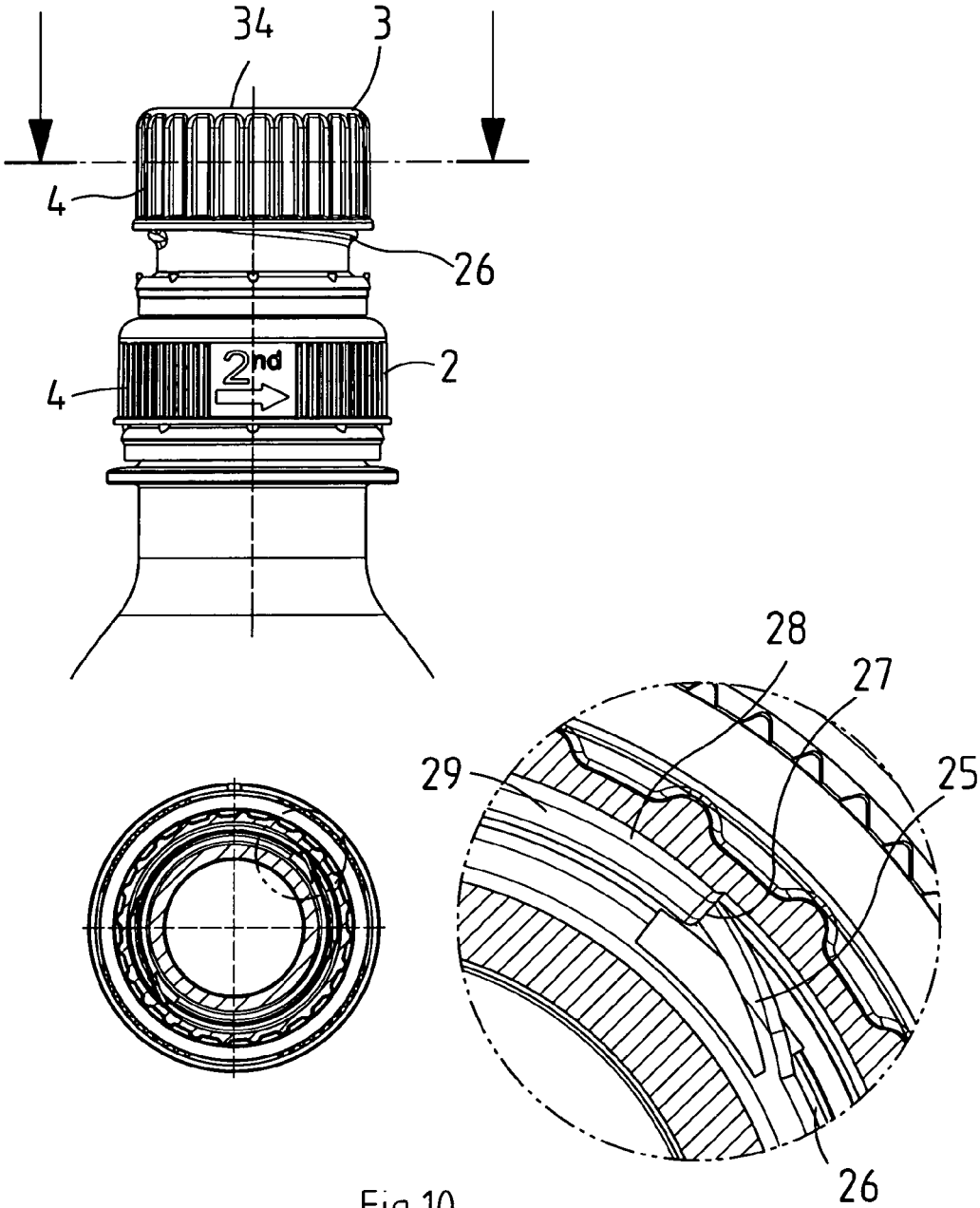

FIG. 10 shows a side view of the closure (top), a sectional view along the horizontally broken sectional line (bottom left) as well as an enlarged detail of the sectional view (bottom right). The detailed view clearly shows that the blocking surface 27 of the thread locking mechanism 25, which is configured in the outer thread 26 of the closure cap 2 as a spring-loaded finger, lies against the inner thread 28 of the screw cap 3. The screw cap 3 and the support element 5 of the closure cap 2 can be locked by means of at least one thread locking mechanism 25 in such a way that, after traversing a certain twisting segment, the screw cap 3 is blocked against further twisting relative to the closure cap 2 in the same direction of rotation.

Figure 11:
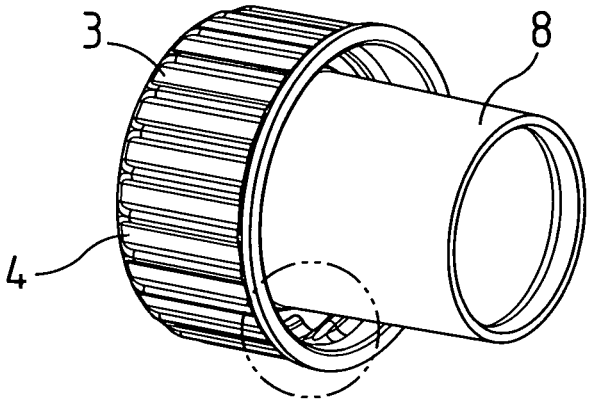
Figure 11:
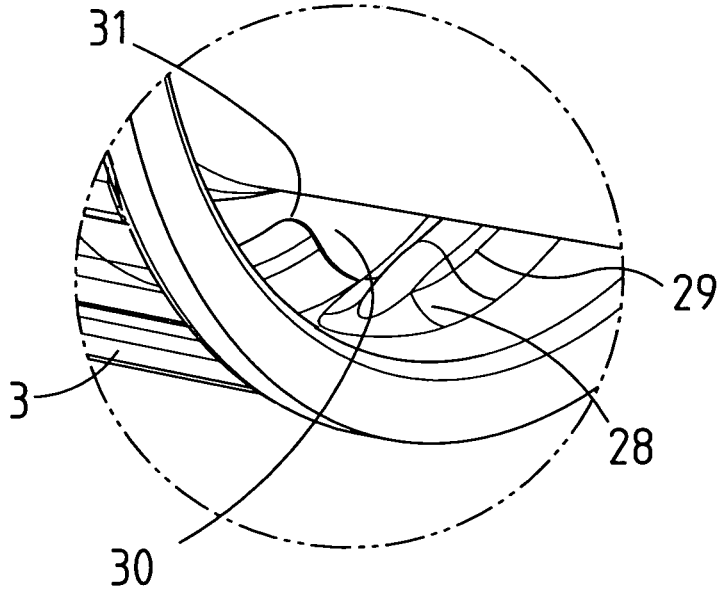

FIG. 11 shows a perspective view of the screw cap 3 (top) as well as a detailed view of it (bottom). Here, it is easy to see the interruption 30 in a thread of the inner thread 28 of the screw cap 3, whereby the spring-loaded fingers can click into the interruption 30. The interruption 30 has a steep flank 31 against which the blocking surface 27 can be laid.

Figure 12:
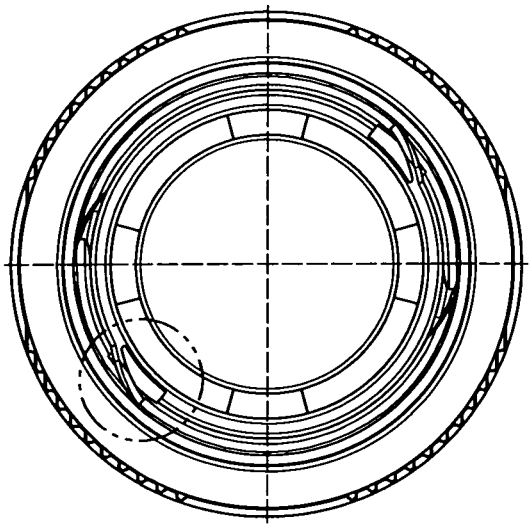
Figure 12:
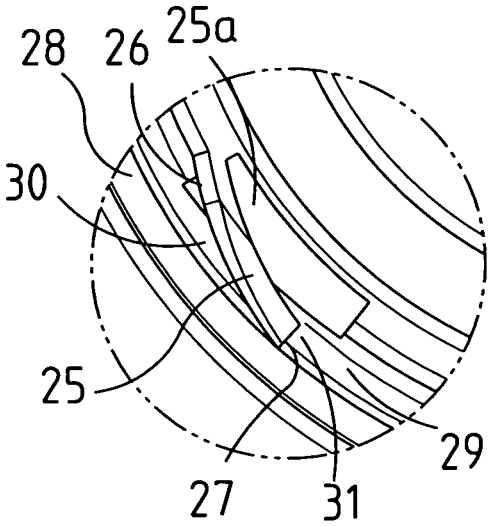

FIG. 12 shows a side view (right) of the closure cap 2 and of the screw cap 3 as well as a detailed view (left) of the spring-loaded finger according to FIG. 11. FIG. 12 shows a spring-loaded finger whose blocking surface 27 lies against a steep flank 31 of an interruption 30 in the thread 29 of the inner thread 28 of the screw cap 3. The undercut **25*a*** is likewise visible.

Figure 13:
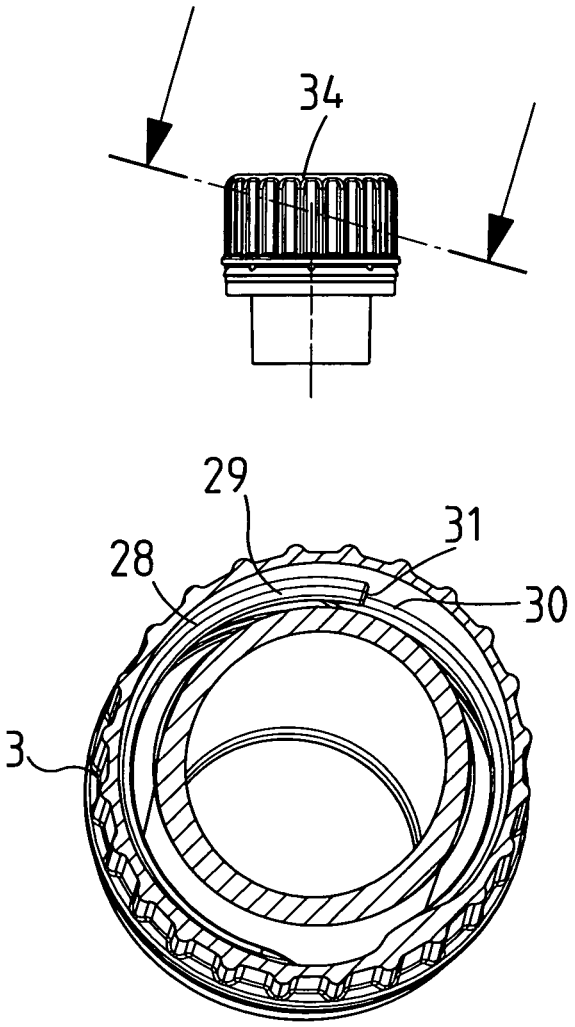

FIG. 13 shows a side view of the screw cap 3 and a perspective view of a slanted section through the screw cap 3 along the slanted broken sectional line. FIG. 13 shows a perspective view of a steep flank 31 of a thread 29, which has an interruption 30.

Figure 14:
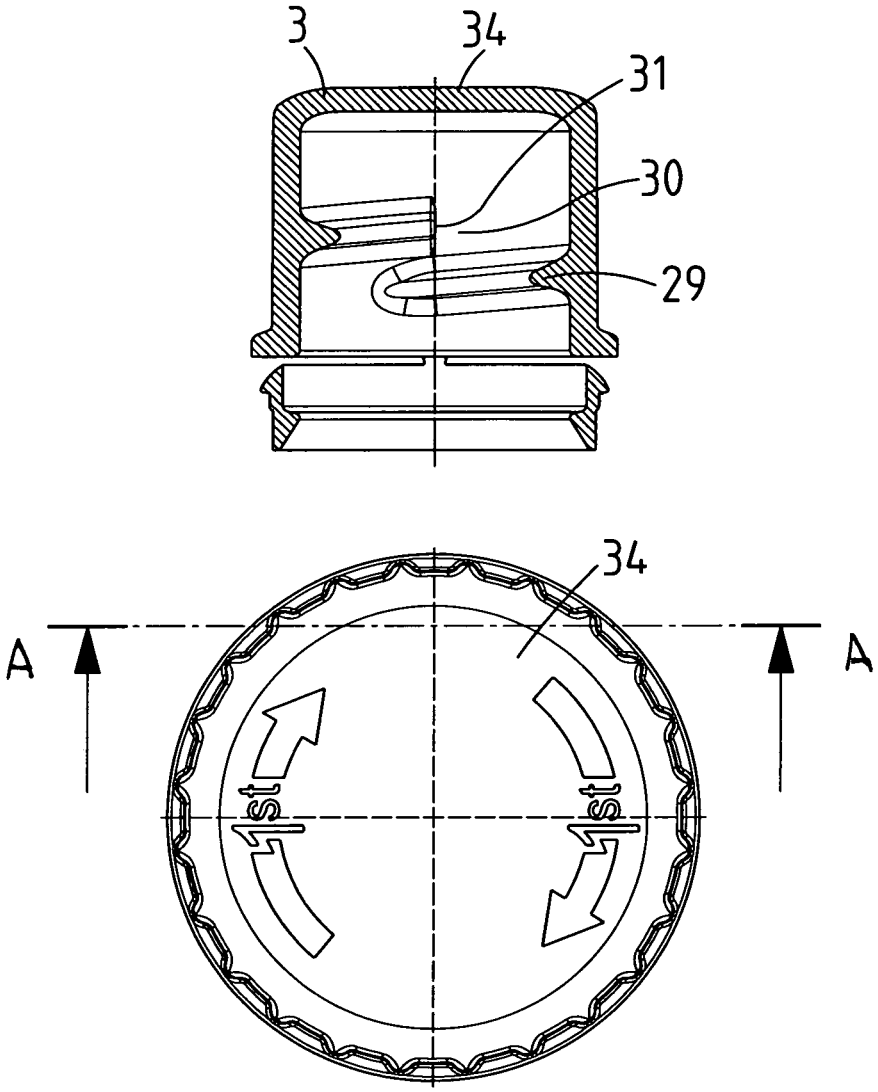

FIG. 14 shows (bottom) a top view of the previously described screw cap 3 and (top) a cross section that runs off-centered along the line A-A. The cross section clearly shows the interruption 30 in the thread 29 and the steep flank 31.

The reference numerals that are identical in the figures all relate to identical or corresponding components and features of the closure shown in the figures.

The invention claimed is:

1. A closure to be screwed onto a container, comprising: a closure cap and a screw cap that can be twisted together with each other as well as relative to each other, the closure cap including a support element that is screwed to the screw cap, whereby the closure cap and the screw cap define a chamber that holds a substance and that is opened by twisting the screw cap relative to the closure cap, thereby opening up at least one passage that is in communication with the container, wherein the screw cap has a chamber wall whose free end surrounds a chamber bottom formed in the closure cap and a lid section onto which the chamber wall is formed, wherein the screw cap and the support element of the closure cap are locked by at least one thread locking mechanism configured as a spring-loaded finger located in an outer thread of the support element and that, under elastic pre-tensioning, is laid with its blocking surface against an inner thread of the screw cap such that after a few twists of the screw cap relative to the closure cap, further relative twisting of the screw cap is blocked.

2. The closure according to claim 1, wherein the screw cap can be twisted a designated rotational distance relative to the closure cap without the closure cap being twisted with the screw cap, and then, after the designated rotational distance has been passed, the screw cap carries along the closure cap.

3. The closure according to claim 1, wherein at least one individual thread of the inner thread of the screw cap is configured with an interruption into which the spring-loaded finger can click.

4. The closure according to claim 3, wherein the interruption has a steep flank against which the blocking surface of the spring-loaded finger is laid.

5. The closure according to claim 1, wherein a slanted or beveled surface of the chamber bottom faces the chamber.

6. The closure according to claim 5, wherein the surface is configured as a conical surface.

7. The closure according to claim 1, wherein the passage is configured as a recess in a connection wall that has a U-shaped cross section so that the chamber bottom is shaped onto the closure cap.

8. The closure according to claim 1, wherein the free end of the chamber wall of the screw cap has a first encircling sealing bead that is laid against the chamber bottom so as to create a seal.

9. The closure according to claim 1, wherein the chamber wall of the screw cap has a second encircling sealing bead that faces away from the free end of said chamber wall and that lies against an inner wall of the support element of the closure cap so as to create a seal.

10. The closure according to claim 1, wherein the chamber wall of the screw cap is surrounded by a first threaded crown on which a first safety ring having predetermined breaking points is arranged.

11. The closure according to claim 10, wherein the first safety ring grasps behind a first edge that is formed around the support element of the closure cap.

12. The closure according to claim 1, wherein the support element of the closure cap is surrounded by a second threaded crown on which a second safety ring having predetermined breaking points is arranged, whereby the second safety ring is provided in order to grasp behind a second edge that encircles a container.

13. The closure according to claim 1, wherein on the support element of the closure cap, a third encircling sealing bead protruding outwards is provided that is laid against an interior of the container so as to create a seal.

* * * * *